US011154168B1

(12) United States Patent
Johnson

(10) Patent No.: US 11,154,168 B1
(45) Date of Patent: Oct. 26, 2021

(54) TOILET SEAT CONDITIONING ASSEMBLY

(71) Applicant: Monica Johnson, Marlin, TX (US)

(72) Inventor: Monica Johnson, Marlin, TX (US)

( * ) Notice: Subject to any disclaimer, the term of this patent is extended or adjusted under 35 U.S.C. 154(b) by 0 days.

(21) Appl. No.: 16/943,332

(22) Filed: Jul. 30, 2020

(51) Int. Cl.
*A47K 13/30* (2006.01)

(52) U.S. Cl.
CPC ..... *A47K 13/305* (2013.01); *A47K 13/307* (2013.01)

(58) Field of Classification Search
CPC ..... A47K 13/005; A47K 13/04; A47K 13/14; A47K 13/30; A47K 13/305; A47K 13/307; A47C 7/021–0213; A47C 7/72–748; F25B 21/02–04; H05B 3/342
See application file for complete search history.

(56) References Cited

U.S. PATENT DOCUMENTS 2,706,767 A * 4/1955 Packchanian ..... H05B 3/00 219/529
2,972,034 A 2/1961 Easley
3,073,937 A 1/1963 Easley
4,920,583 A * 5/1990 Hough ..... A47K 13/24 4/234
5,084,917 A 2/1992 Matsubara
5,461,732 A * 10/1995 Reiman ..... A47K 13/14 4/245.3
5,666,672 A 9/1997 Birsel
5,940,895 A 8/1999 Wilson
D460,162 S 7/2002 Currier
7,161,118 B1 1/2007 Modeste, Sr.
7,866,743 B1 * 1/2011 Russell ..... A47C 7/74 297/180.12
8,112,825 B2 * 2/2012 Li ..... A47K 13/24 4/237
8,117,683 B2 * 2/2012 Yamamoto ..... A47K 13/305 4/237
8,864,221 B1 * 10/2014 Delvilla ..... A47C 7/021 297/31
2008/0015665 A1 * 1/2008 Lachenbruch ..... A61F 7/0097 607/104
2008/0060119 A1 3/2008 Pinizzotto
2010/0032426 A1 2/2010 Rendon
2013/0008181 A1 * 1/2013 Makansi ..... F25B 21/04 62/3.3
2019/0343716 A1 * 11/2019 Johnson-Kendrick ..... A61H 15/02

* cited by examiner

*Primary Examiner* — David P Angwin
*Assistant Examiner* — Nicholas A Ros

(57) ABSTRACT

A toilet seat conditioning assembly for heating or cooling a toilet seat includes a cover that is formed into a circular shape for positioning on top of a toilet seat. A thermal unit is integrated into the cover and the thermal unit is actuatable to heat the cover or the cool the cover to enhance comfort for the user. A plurality of vibration units is each integrated into the cover. Each of the vibration units vibrates the cover when the vibration units are turned on to enhance comfort for the user. A remote control is in remote communication with the thermal unit and each of the vibration units for remotely controlling the thermal unit and the vibration units.

15 Claims, 6 Drawing Sheets

TOILET SEAT CONDITIONING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to seat conditioning devices and more particularly pertains to a new seat conditioning device for heating or cooling a toilet seat.

(2) Description of Related Art Including Information Disclosed Under 37 CFR 1.97 and 1.98

The prior art relates to seat conditioning devices including a variety of toilet seats that has heating elements integrated therein for heating the toilet seats. In at least one instance the prior art includes a thermostat for sensing the temperature of the toilet seat. The prior art discloses a toilet seat that is removably attached to a toilet to facilitate the toilet seat to be removed for cleaning. The prior art discloses a membrane that has heating elements integrated therein and the membrane is adhesively attachable to a toilet seat. The prior art discloses a deodorizing toilet seat for removing odors associated with a toilet.

BRIEF SUMMARY OF THE INVENTION

An embodiment of the disclosure meets the needs presented above by generally comprising a cover that is formed into a circular shape for positioning on top of a toilet seat. A thermal unit is integrated into the cover and the thermal unit is actuatable to heat the cover or the cool the cover to enhance comfort for the user. A plurality of vibration units is each integrated into the cover. Each of the vibration units vibrates the cover when the vibration units are turned on to enhance comfort for the user. A remote control is in remote communication with the thermal unit and each of the vibration units for remotely controlling the thermal unit and the vibration units.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
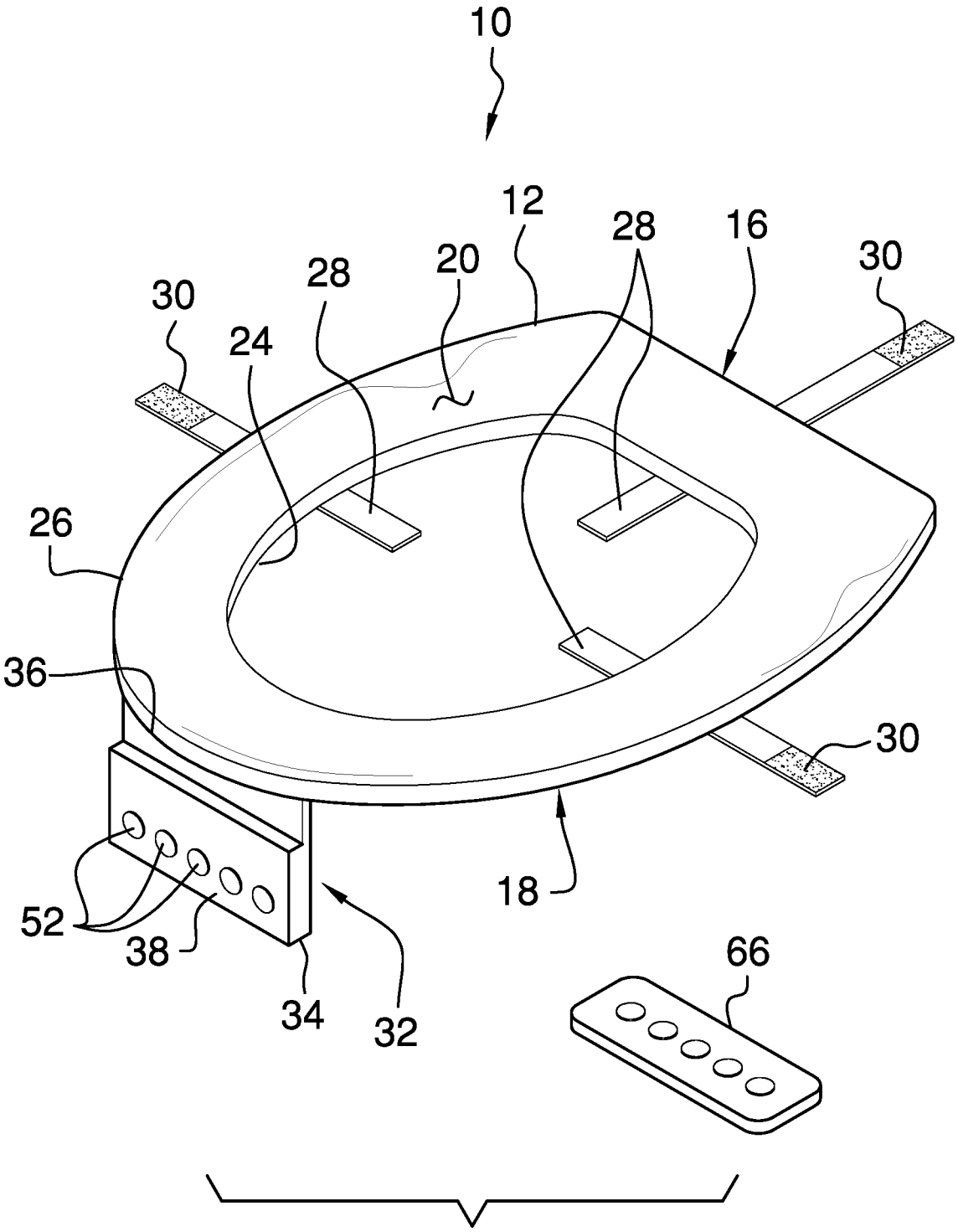
FIG. 1 is a perspective view of a toilet seat conditioning assembly according to an embodiment of the disclosure.
Figure 2:
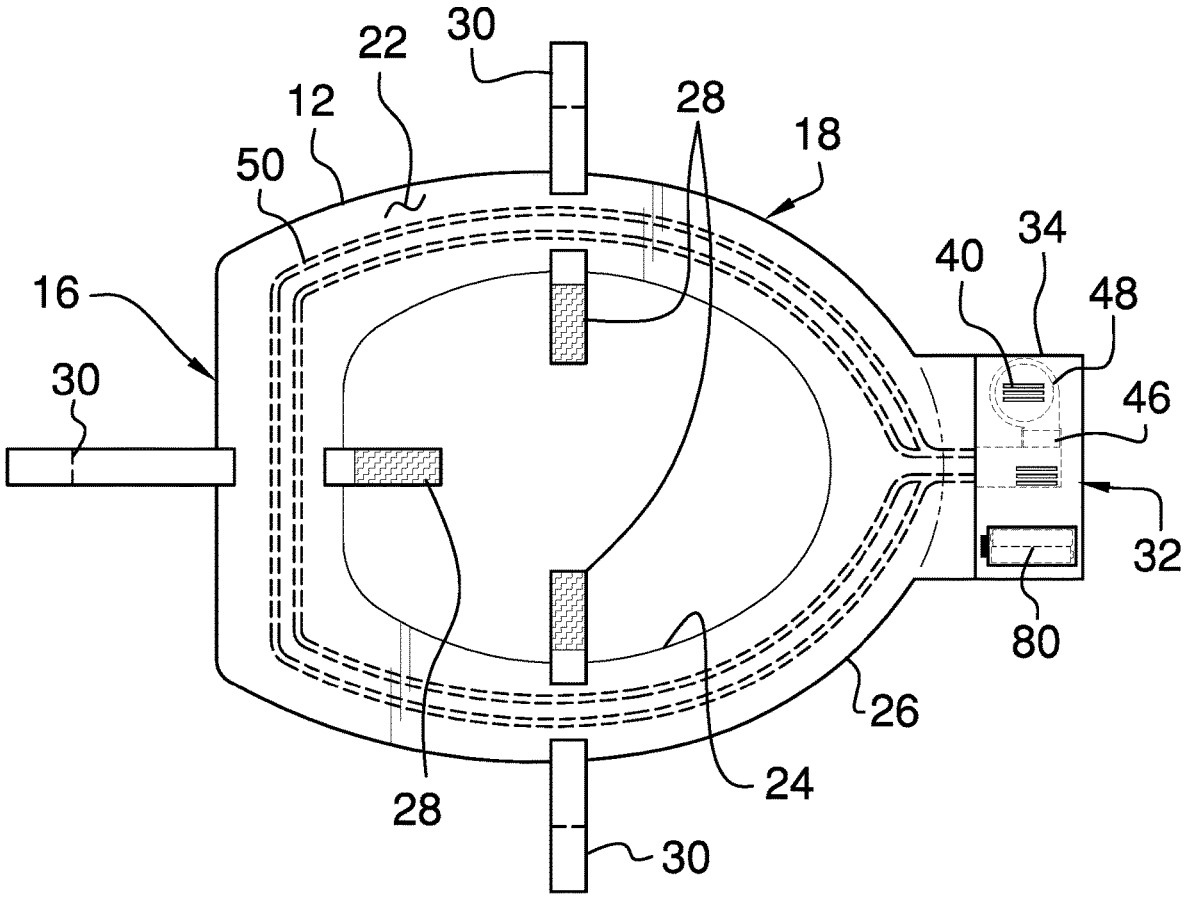
FIG. 2 is a bottom phantom view of an embodiment of the disclosure.
Figure 3:
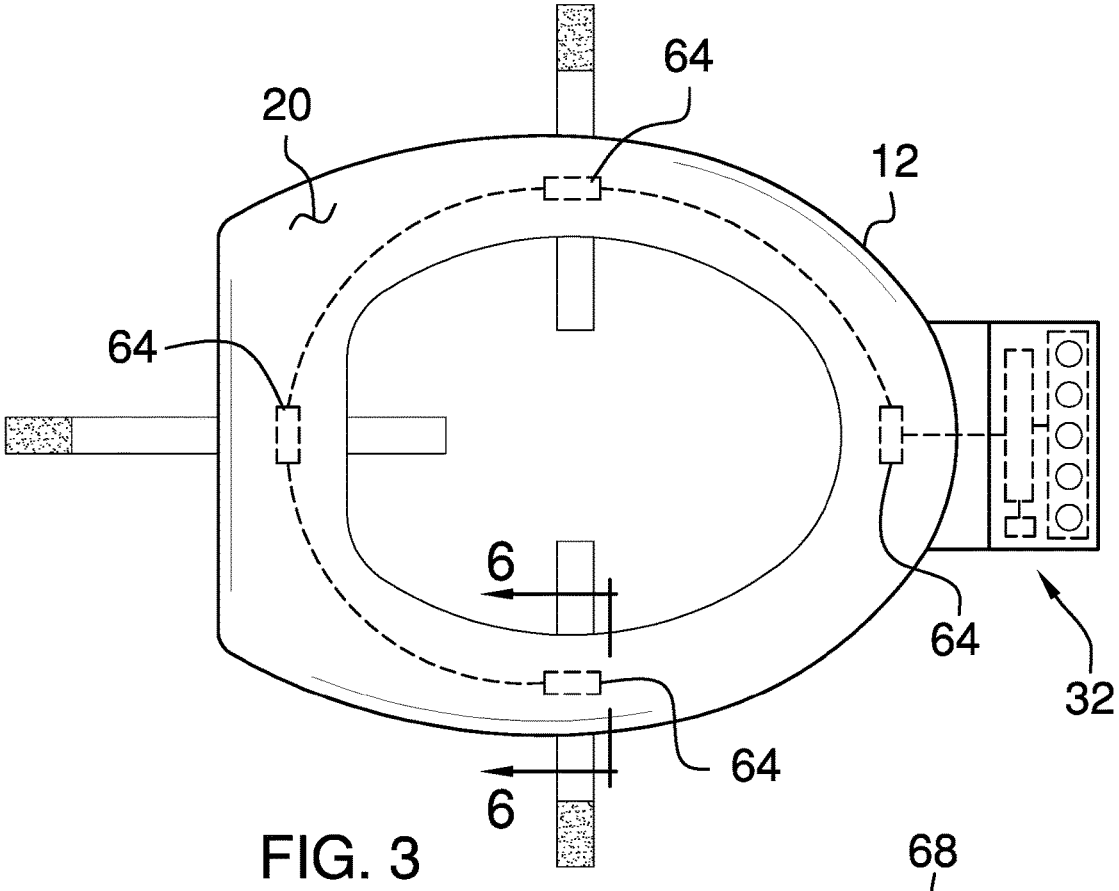
FIG. 3 is a top phantom view of an embodiment of the disclosure.
Figure 4:
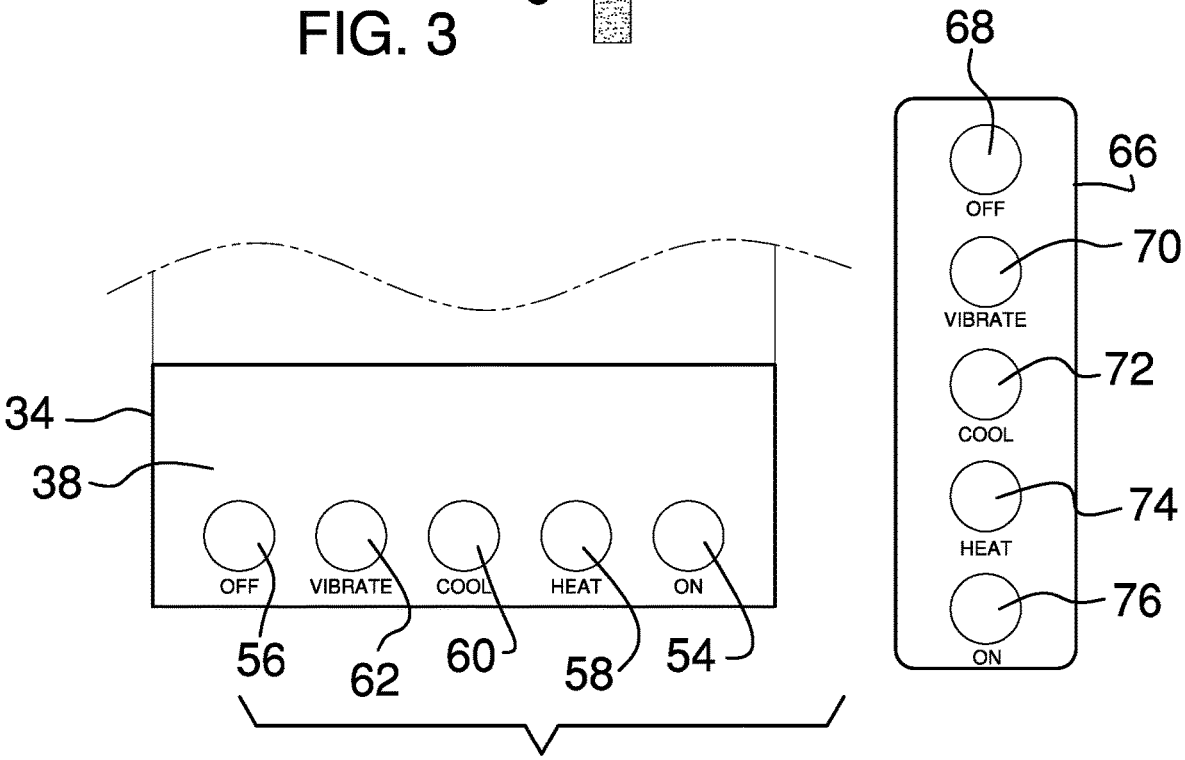
FIG. 4 is a perspective view of a housing and a remote control of an embodiment of the disclosure.
Figure 5:
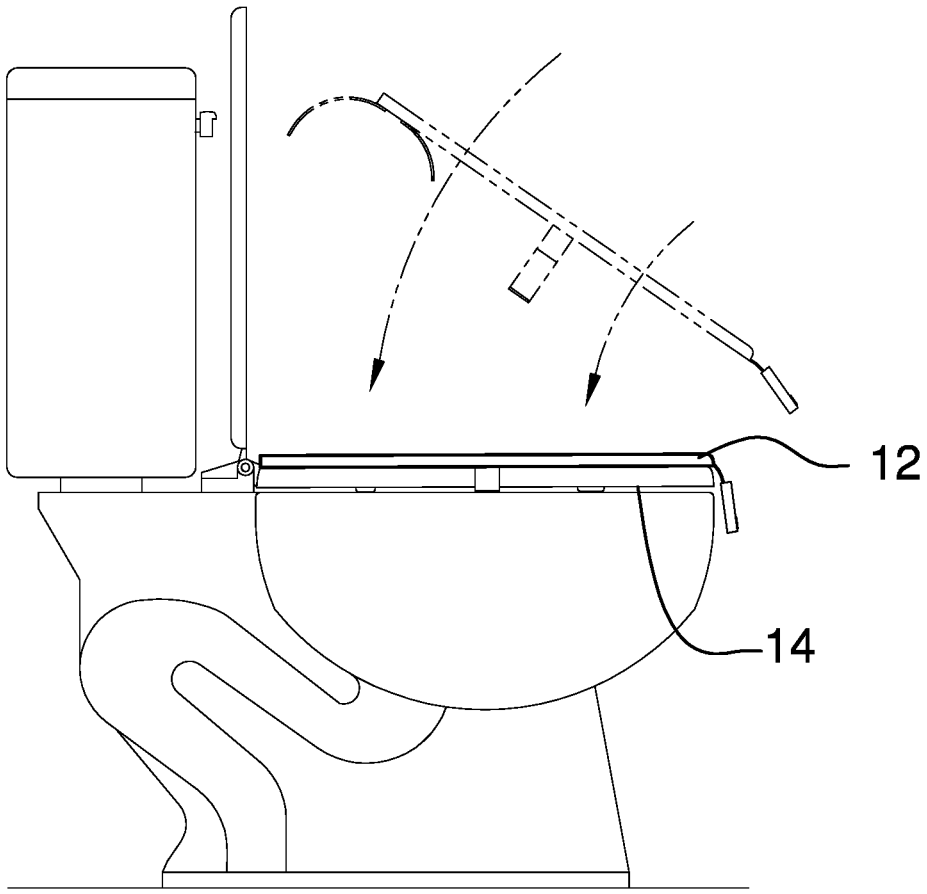
FIG. 5 is a perspective in-use view of an embodiment of the disclosure.
Figure 6:
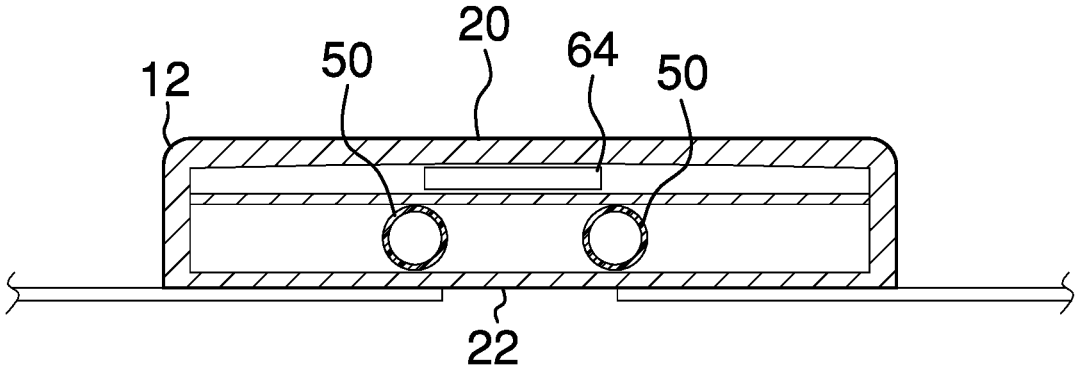
FIG. 6 is a cross sectional view taken along line 6-6 of FIG. 3 of an embodiment of the disclosure.
Figure 7:
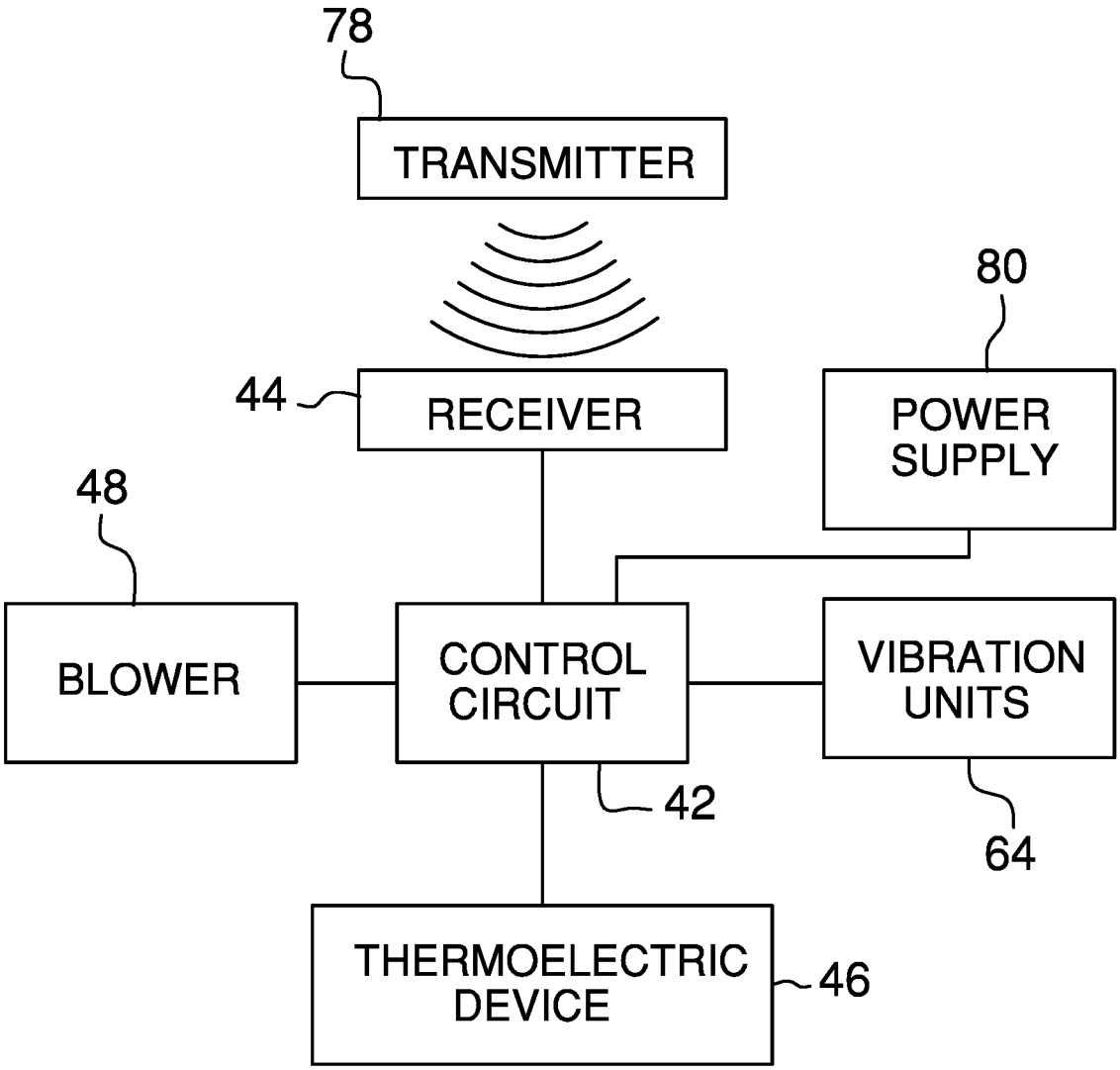
FIG. 7 is a schematic view of an embodiment of the disclosure.

With reference now to the drawings, and in particular to FIGS. 1 through 7 thereof, a new seat conditioning device embodying the principles and concepts of an embodiment of the disclosure and generally designated by the reference numeral 10 will be described.

As best illustrated in FIGS. 1 through 7, the toilet seat conditioning assembly 10 generally comprises a cover 12 that is formed into a circular shape for positioning on top of a toilet seat 14. The cover 12 has a rear portion 16 and a forward portion 18. The rear portion 16 is elongated along a longitudinal axis and the forward portion 18 curves forwardly from the rear portion 16. The cover 12 has a top surface 20, a bottom surface 22, an inner edge 24 and an outer edge 26.

A plurality of first straps 28 is each coupled to the inner edge 24 of the cover 12. The first straps 28 are spaced apart from each other and are distributed around the inner edge 24. In this way each of the first straps 28 can be extended beneath the toilet seat 14 when the cover 12 is placed on the toilet seat 14. A plurality of second straps 30 is each coupled to the outer edge 26 of the cover 12 and each of the second straps 30 is aligned with a respective one of the first straps 28. Thus, each of the second straps 30 can be extended beneath the toilet seat 14 when the cover 12 is placed on the toilet seat 14. Each of the second straps 30 is releasably matable to a respective one of the first straps 28 to retain the cover 12 on the toilet seat 14.

A thermal unit 32 is integrated into the cover 12 and the thermal unit 32 is in thermal communication with the cover 12. The thermal unit 32 is actuatable into a heating condition for heating the cover 12 to enhance comfort for the user. The thermal unit 32 is actuatable into a cooling condition for cooling the cover 12 to enhance comfort for the user. The thermal unit 32 comprises a housing 34 that has an upper edge 36 and a front face 38. The upper edge 36 is coupled to the bottom surface 22 of the cover 12 and the housing 34 is positioned on the forward portion 18 of the cover 12. Additionally, the housing 34 is aligned with an apex of the curvature of the forward portion 18 such that the housing 34 is accessible to the user when the cover 12 is positioned on the toilet seat 14 and the user sits on the cover 12.

The housing 34 has a plurality of vents 40 each extending into an interior of the housing 34 to pass air therethrough. A control circuit 42 is positioned in the housing 34 and the control circuit 42 receives a heat input, a cool input, a vibrate input and an off input. Additionally, a receiver 44 is positioned in the housing 34 and the receiver 44 is electrically coupled to the control circuit 42. The receiver 44 may comprise a radio frequency receiver or the like.

The thermal unit 32 includes a thermal electric device 46 that is positioned in the housing 34 and the thermal electric device 46 is electrically coupled to the control circuit 42. The thermal electric device 46 is actuated into a heating condition having the thermal electric device 46 producing heat when the control circuit 42 receives the heat input. The thermal electric device 46 is actuated into a cooling condition having the thermal electric device 46 absorbing heat when the control circuit 42 receives the cool input. The thermal electric device 46 is turned off when the control circuit 42 receives the off input. The thermal electric device 46 may comprise a Peltier device or other similar thermoelectric device that can produce heat or absorb heat.

The thermal unit 32 includes a blower 48 that is positioned in the housing 34 and the blower 48 is electrically coupled to the control circuit 42. The blower 48 is turned on when the control circuit 42 receives the cool input to blow air across the thermal electric device 46 for cooling the thermal electric device 46. The blower 48 may include an electric motor and a fan or other type of electronic blower 48. The thermal unit 32 includes an array of thermal conductors 50 that is integrated into the cover 12. The array of thermal conductors 50 is positioned between the top surface 20 and the bottom surface 22 of the cover 12. Additionally, the array of thermal conductors 50 is in thermal communication with the thermal electric device 46 and with the cover 12. Moreover, the array of thermal conductors 50 is heated when the thermal electric device 46 is actuated into the heating condition thereby heating the cover 12. Conversely, the array of thermal conductors 50 is cooled when the thermal electric device 46 is actuated into the cooling condition thereby cooling the cover 12.

The thermal unit 32 includes a plurality control buttons 52 and each of the control buttons 52 is movably coupled to the front face 38 of the housing 34. Each of the control buttons 52 is electrically coupled to the control circuit 42. The control buttons 52 includes an on button 54, an off button 56, a heat button 58, a cool button 60 and a vibrate button 62. The control circuit 42 receives the off input when the off button 56 is depressed. The control circuit 42 receives the heat input when the heat button 58 is depressed and the control circuit 42 receives the cool input when the cool button 60 is depressed. The control circuit 42 receives the vibrate input when the vibrate button 62 is depressed and the control circuit 42 is turned on when the on button 54 is depressed.

A plurality of vibration units 64 is provided and each of the vibration units 64 is integrated into the cover 12. Each of the vibration units 64 is in mechanical communication with the cover 12 such that each of the vibration units 64 vibrates the cover 12 when the vibration units 64 are turned on. In this way the vibration units 64 enhance comfort for the user. Each of the vibration units 64 is positioned between the top surface 20 and the bottom surface 22 of the cover 12. Each of the vibration units 64 is electrically coupled to the control circuit 42 and each of the vibration units 64 is turned on when the control circuit 42 receives the vibrate input. Each of the vibration units 64 may include an electric motor and a cam that has an offset axis of rotation or other type of electronic vibration device.

A remote control 66 is provided and the remote control 66 is in remote communication with the thermal unit 32 and each of the vibration units 64 for remotely controlling the thermal unit 32 and the vibration units 64. The remote control 66 includes an off button 68, a vibrate button 70, a cool button 72, a heat button 74 and an on button 76. The remote control 66 includes a transmitter 78 and the transmitter 78 is in wireless communication with the receiver 44. The transmitter 78 may be a radio frequency transmitter or the like. The control circuit 42 receives a respective vibrate input, cool input, heat input and off input when a respective vibrate button 70, cool button 72, heat button 74 or off button 68 on the remote control 66 are depressed. A power supply 80 is removably positioned in the housing 34, the power supply 80 is electrically coupled to the control circuit 42 and the power supply 80 comprises at least one battery.

In use, the cover 12 is placed on the toilet seat 14 and each of the first straps 28 and the second straps 30 are wrapped around the toilet seat 14 to attach the cover 12 to the toilet seat 14. Thus, the user can sit on the cover 12 when the user sits on the toilet seat 14. The thermal unit 32 can be turned on to heat the cover 12 or to cool the cover 12. In this way the thermal unit 32 enhances comfort for the user when the user sits on the cover 12. The vibration units 64 can also be turned on to vibrate the cover 12 to facilitate a pleasing sensation when the user sits on the cover 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet seat conditioning assembly for heating or cooling a toilet seat to enhance comfort for a user, said assembly comprising:

a cover being formed into a circular shape wherein said cover is configured to be positioned on top of a toilet seat, wherein said cover has a rear portion and a forward portion, said rear portion being elongated along a longitudinal axis, said forward portion curving forwardly from said rear portion, said cover having a top surface, a bottom surface, an inner edge and an outer edge;

a thermal unit being integrated into said cover, said thermal unit being in thermal communication with said cover, said thermal unit being actuatable into a heating condition for heating said cover wherein said thermal unit is configured to enhance comfort for the user, said thermal unit being actuatable into a cooling condition for cooling said cover wherein said thermal unit is configured to enhance comfort for the user, wherein said thermal unit comprises a housing having an upper edge and a front face, said upper edge being coupled to said bottom surface of said cover, said housing being positioned on said forward portion of said cover, said housing being aligned with an apex of the curvature of said forward portion wherein said housing is configured to be accessible to the user when said cover is positioned on the toilet seat and the user sits on said cover, said housing having a plurality of vents each extending into an interior of said housing wherein each of said vents is configured to pass air therethrough;

a plurality of vibration units, each of said vibration units being integrated into said cover, each of said vibration units being in mechanical communication with said cover such that each of said vibration units vibrates said cover when said vibration units are turned on wherein said vibration units are configured to enhance comfort for the user; and a remote control being in remote communication with said thermal unit and each of said vibration units for remotely controlling said thermal unit and said vibration units.

2. The assembly according to claim 1, further comprising a plurality of first straps, each of said first straps being coupled to said inner edge of said cover, said first straps being spaced apart from each other and being distributed around said inner edge wherein each of said first straps is configured to be extended beneath the toilet seat when said cover is placed on the toilet seat.

3. The assembly according to claim 2, further comprising a plurality of second straps, each of said second straps being coupled to said outer edge of said cover, each of said second straps being aligned with a respective one of said first straps wherein each of said second straps is configured to be extended beneath the toilet seat when said cover is placed on the toilet seat, each of said second straps being releasably matable to a respective one of said first straps wherein each of said first straps and said second straps are configured to retain said cover on the toilet seat.

4. The assembly according to claim 1, wherein said thermal unit includes a control circuit being positioned in said housing, said control circuit receiving a heat input, a cool input, a vibrate input and an off input.

5. The assembly according to claim 4, wherein said thermal unit includes a receiver being positioned in said housing, said receiver being electrically coupled to said control circuit.

6. The assembly according to claim 4, wherein said thermal unit includes a thermal electric device being positioned in said housing, said thermal electric device being electrically coupled to said control circuit, said thermal electric device being actuated into a heating condition having said thermal electric device producing heat when said control circuit receives said heat input, said thermal electric device being actuated into a cooling condition having said thermal electric device absorbing heat when said control circuit receives said cool input, said thermal electric device being turned off when said control circuit receives said off input.

7. The assembly according to claim 6, wherein said thermal unit includes a blower being positioned in said housing, said blower being electrically coupled to said control circuit, said blower being turned on when said control circuit receives said cool input wherein said blower is configured to blow air across said thermal electric device for cooling said thermal electric device.

8. The assembly according to claim 6, wherein said thermal unit includes an array of thermal conductors, said array of thermal conductors being integrated into said cover having said array of thermal conductors being positioned between said top surface and said bottom surface of said cover, said array of thermal conductors being in thermal communication with said thermal electric device, said array of thermal conductors being in thermal communication with said cover.

9. The assembly according to claim 8, wherein said array of thermal conductors is heated when said thermal electric device is actuated into said heating condition thereby heating said cover, said array of thermal conductors being cooled when said thermal electric device is actuated into said cooling condition thereby cooling said cover.

10. The assembly according to claim 4, wherein said thermal unit includes a plurality control buttons, each of said control buttons being movably coupled to said front face of said housing, each of said control buttons being electrically coupled to said control circuit, said control buttons including an on button, an off button, a heat button, a cool button and a vibrate button.

11. The assembly according to claim 10, wherein said control circuit receives said off input when said off button is depressed, said control circuit receiving said heat input when said heat button is depressed, said control circuit receiving said cool input when said cool button is depressed, said control circuit receiving said vibrate input when said vibrate button is depressed, said control circuit being turned on when said on button is depressed.

12. The assembly according to claim 4, wherein each of said vibration units is positioned between said top surface and said bottom surface of said cover, each of said vibration units being electrically coupled to said control circuit, each of said vibration units being turned on when said control circuit receives said vibrate input.

13. The assembly according to claim 5, wherein said remote control includes an off button, a vibrate button, a cool button, a heat button and an on button, the remote control includes a transmitter and the transmitter is in wireless communication with the receiver, said control circuit receiving a respective vibrate input, cool input, heat input and off input when said vibrate button, said cool button, said heat button or said off button on said remote control are depressed.

14. The assembly according to claim 4, further comprising a power supply being removably positioned in said housing, said power supply being electrically coupled to said control circuit, said power supply comprising at least one battery.

15. A toilet seat conditioning assembly for heating or cooling a toilet seat to enhance comfort for a user, said assembly comprising:

a cover being formed into a circular shape wherein said cover is configured to be positioned on top of a toilet seat, said cover having a rear portion and a forward portion, said rear portion being elongated along a longitudinal axis, said forward portion curving forwardly from said rear portion, said cover having a top surface, a bottom surface, an inner edge and an outer edge;

a plurality of first straps, each of said first straps being coupled to said inner edge of said cover, said first straps being spaced apart from each other and being distributed around said inner edge wherein each of said first straps is configured to be extended beneath the toilet seat when said cover is placed on the toilet seat;

a plurality of second straps, each of said second straps being coupled to said outer edge of said cover, each of said second straps being aligned with a respective one of said first straps wherein each of said second straps is configured to be extended beneath the toilet seat when said cover is placed on the toilet seat, each of said second straps being releasably matable to a respective one of said first straps wherein each of said first straps and said second straps are configured to retain said cover on the toilet seat;

a thermal unit being integrated into said cover, said thermal unit being in thermal communication with said cover, said thermal unit being actuatable into a heating condition for heating said cover wherein said thermal unit is configured to enhance comfort for the user, said thermal unit being actuatable into a cooling condition for cooling said cover wherein said thermal unit is configured to enhance comfort for the user, said thermal unit comprising:

a housing having an upper edge and a front face, said upper edge being coupled to said bottom surface of said cover, said housing being positioned on said forward portion of said cover, said housing being aligned with an apex of the curvature of said forward portion wherein said housing is configured to be accessible to the user when said cover is positioned on the toilet seat and the user sits on said cover, said housing having a plurality of vents each extending into an interior of said housing wherein each of said vents is configured to pass air therethrough;

a control circuit being positioned in said housing, said control circuit receiving a heat input, a cool input, a vibrate input and an off input;

a receiver being positioned in said housing, said receiver being electrically coupled to said control circuit;

a thermal electric device being positioned in said housing, said thermal electric device being electrically coupled to said control circuit, said thermal electric device being actuated into a heating condition having said thermal electric device producing heat when said control circuit receives said heat input, said thermal electric device being actuated into a cooling condition having said thermal electric device absorbing heat when said control circuit receives said cool input, said thermal electric device being turned off when said control circuit receives said off input;

a blower being positioned in said housing, said blower being electrically coupled to said control circuit, said blower being turned on when said control circuit receives said cool input wherein said blower is configured to blow air across said thermal electric device for cooling said thermal electric device;

an array of thermal conductors, said array of thermal conductors being integrated into said cover having said array of thermal conductors being positioned between said top surface and said bottom surface of said cover, said array of thermal conductors being in thermal communication with said thermal electric device, said array of thermal conductors being in thermal communication with said cover, said array of thermal conductors being heated when said thermal electric device is actuated into said heating condition thereby heating said cover, said array of thermal conductors being cooled when said thermal electric device is actuated into said cooling condition thereby cooling said cover;

a plurality control buttons, each of said control buttons being movably coupled to said front face of said housing, each of said control buttons being electrically coupled to said control circuit, said control buttons including an on button, an off button, a heat button, a cool button and a vibrate button, said control circuit receiving said off input when said off button is depressed, said control circuit receiving said heat input when said heat button is depressed, said control circuit receiving said cool input when said cool button is depressed, said control circuit receiving said vibrate input when said vibrate button is depressed, said control circuit being turned on when said on button is depressed;

a plurality of vibration units, each of said vibration units being integrated into said cover, each of said vibration units being in mechanical communication with said cover such that each of said vibration units vibrates said cover when said vibration units are turned on wherein said vibration units are configured to enhance comfort for the user, each of said vibration units being positioned between said top surface and said bottom surface of said cover, each of said vibration units being electrically coupled to said control circuit, each of said vibration units being turned on when said control circuit receives said vibrate input;

a remote control being in remote communication with said thermal unit and each of said vibration units for remotely controlling said thermal unit and said vibration units, said remote control including an off button, a vibrate button, a cool button, a heat button and an on button, the remote control includes a transmitter and the transmitter is in wireless communication with the receiver, said control circuit receiving a respective vibrate input, cool input, heat input and off input when said vibrate button, said cool button, said heat button or said off button on said remote control are depressed; and a power supply being removably positioned in said housing, said power supply being electrically coupled to said control circuit, said power supply comprising at least one battery.

* * * * *